US006582328B2

(12) United States Patent
Kuta et al.

(10) Patent No.: US 6,582,328 B2
(45) **Date of Patent: *Jun. 24, 2003**

(54) SYSTEM AND METHOD FOR COLLECTING AND MANAGING DATA

(75) Inventors: Todd M. Kuta, Scottsdale, AZ (US); Scott I. Lambrecht, Scottsdale, AZ (US); Peter G. Charleston, Scottsdale, AZ (US)

(73) Assignee: Golflogix Inc., Scottsdale, AZ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/437,656

(22) Filed: Nov. 10, 1999

(65) Prior Publication Data

US 2002/0019276 A1 Feb. 14, 2002

(51) Int. Cl.[7] ..... A63B 71/06
(52) U.S. Cl. ..... 473/405; 473/406; 473/407
(58) Field of Search ..... 473/405–407

(56) References Cited

U.S. PATENT DOCUMENTS

| | | | | | |
|---|---|---|---|---|---|
| 3,895,366 | A | * | 7/1975 | Morris | 340/207 R |
| 5,095,430 | A | * | 3/1992 | Bonito et al. | 364/410 |
| 5,146,557 | A | * | 9/1992 | Yamrom et al. | 395/161 |
| 5,319,548 | A | * | 6/1994 | Germain | 364/410 |
| 5,364,093 | A | * | 11/1994 | Huston et al. | 273/32 R |
| 5,685,786 | A | * | 11/1997 | Dudley | 473/407 |
| 5,810,680 | A | * | 9/1998 | Lobb et al. | 473/407 |
| 5,873,797 | A | * | 2/1999 | Garn | 473/407 |
| 5,878,369 | A | * | 3/1999 | Rudow et al. | 701/215 |

* cited by examiner

*Primary Examiner*—S. Thomas Hughes
*Assistant Examiner*—Carmen D. White
(74) *Attorney, Agent, or Firm*—Parsons & Goltry; Robert A. Parsons; Michael W. Goltry

(57) ABSTRACT

A system comprising an individual subscriber unit for collecting golf game data during a game of golf, and a computer for receiving the golf game data from the individual subscriber unit after the game of golf and for generating a report of the golf game data.

21 Claims, 3 Drawing Sheets

42 41 43 44 40 45

| HOLE | SHOT | CLUB | DISTANCE |
|---|---|---|---|
| 1 | 1 | 1W | 225 yds |
| 1 | 2 | 6i | 170 yds |
| 1 | 3 | PW | 52 yds |
| 1 | 4 | Pu | 10 ft |
| | | | |
| | | | |

40

| HOLE (42) | SHOT (41, 43) | CLUB (44) | DISTANCE (45) |
|---|---|---|---|
| 1 | 1 | 1W | 225 yds |
| 1 | 2 | 6i | 170 yds |
| 1 | 3 | PW | 52 yds |
| 1 | 4 | Pu | 10 ft |
| | | | |
| | | | |

SYSTEM AND METHOD FOR COLLECTING AND MANAGING DATA

FIELD OF THE INVENTION

This invention relates to data management systems and, more particularly, to a system and method for collecting and managing data relating to the game of golf.

BACKGROUND OF THE INVENTION

Golf is a cross-country game played by striking a small ball with various clubs from a series of teeing grounds into a like series of holes on a course. The player who holes his ball in the fewest strokes wins. Golf combines with its open air and exercise an intrinsic fascination. Despite its attractiveness and popularity, golf is not a game for everyone; it requires a high degree of skill that is honed only with great patience and dedication, and it requires an investment in equipment and fees that persons of average means may not feel worthwhile. In an effort to become more proficient at the game of golf, dedicated golfers play consistently and pay close attention to their technique and score. Although score cards provide a simple way for golfers to track their scores, it is very difficult if not impossible for golfers to easily record from game to game other useful information golf game data such as ball position along the golf course, club selection and club stroke characteristics.

Accordingly, it would be highly desirable to provide a new and improved system and method for collecting and managing golf game data.

It is a purpose of the invention to provide a new and improved system for collecting and managing golf game data that is easy to use.

It is another purpose of the invention to provide a new and improved system for collecting and managing golf game data that generates a report of the golf game data.

It is still another purpose of the invention to provide a new and improved system for collecting and managing golf game data that utilizes a computer for converting golf game data into a useful report.

It is a further provision of the invention to provide a new and improved system for collecting and managing golf game data, which includes an individual subscriber unit that a golfer may carry and use to input golf game data.

It is still a further provision of the invention to provide golfers with a system that allows them to identify and focus on deficiencies in their golf game.

It is yet still a further purpose of the invention to provide a new and improved method for collecting and managing golf game data that may be employed by a golfer during a game of golf.

It is yet a further purpose of the invention to provide a new and improved system and method for collecting and managing golf game data that incorporates global position system technology.

SUMMARY OF THE INVENTION

The above problems and others are at least partially solved and the above purposes and others realized in new and improved system for measuring, recording and mapping golf game data in terms of one or more golf holes, and/or one or more golf games played over a given period of time such as a week, month, season and/or lifetime. This data can include the path of golf ball traverse through a golf hole(s) and/or course(s); golf club identification; golf hole(s) or golf game(s) scoring; golf course(s) identification; golf ball flight characteristics; and golf club to ball impact characterization data such as whether the ball was hit, square, fat or thin. The system is comprised of apparatus for collecting golf game data and a computer for receiving the golf game data from the apparatus and for generating a report of the golf game data. The apparatus is comprised of an individual subscriber unit having a receiver that communicates with satellites of a Global Positioning System, which allows the path of golf ball traverse over a golf course to be determined. The computer may be contained by the individual subscriber unit or comprise part of a resident or Internet-based service having storage and processing capabilities.

BRIEF DESCRIPTION OF THE DRAWINGS

The foregoing and further and more specific objects and advantages of the invention will become readily apparent to those skilled in the art from the following detailed description taken in conjunction with the drawings in which.

DETAILED DESCRIPTION OF A PREFERRED EMBODIMENT

The present invention tenders the integration and adaptation of global positioning system technology with the game of golf. The invention allows a golfer to measure, record and map various data about his golf game, whether in terms of a single game or multiple games played over a given period of time such as a week, month, season and/or lifetime. This data can include the path of golf ball traverse through a golf hole(s) and/or course(s); golf club identification; golf hole(s) or golf game(s) scoring; golf course(s) identification; golf ball flight characteristics; and golf club to ball impact characterization data such as whether the ball was hit, square, fat or thin. In terms of the invention, golfers can use this data to track their progress and weaknesses in regards to the game of golf over a predetermined period of time or throughout their entire lives. It can also be used simply to provide a golfer with an image of the shot history of a round of golf.

Figure 1:
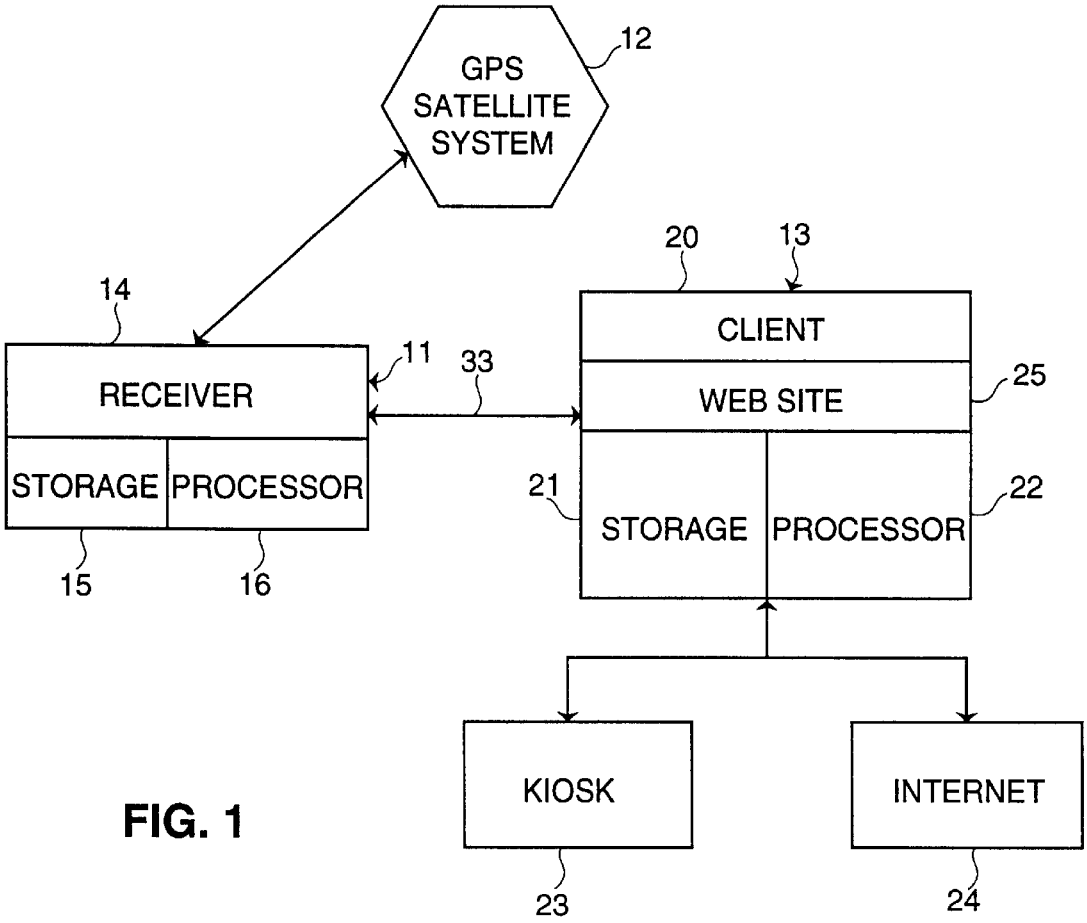
FIG. 1 is a schematic representation of a system for collecting and managing golf game data and for generating a report of golf game data, the system comprising an individual subscriber unit, a global positioning system and a service.
Figure 2:
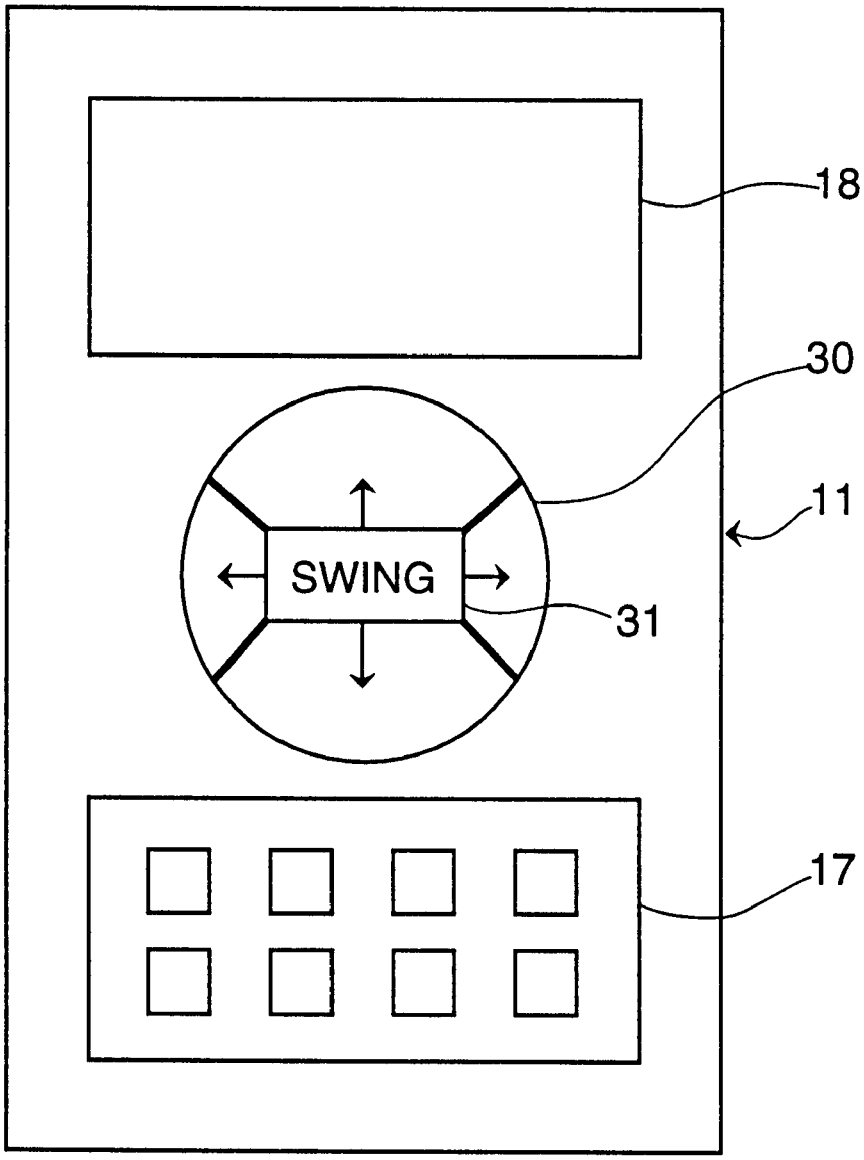
FIG. 2 is a front view of an embodiment of the individual subscriber unit of FIG. 1.
Figure 3:
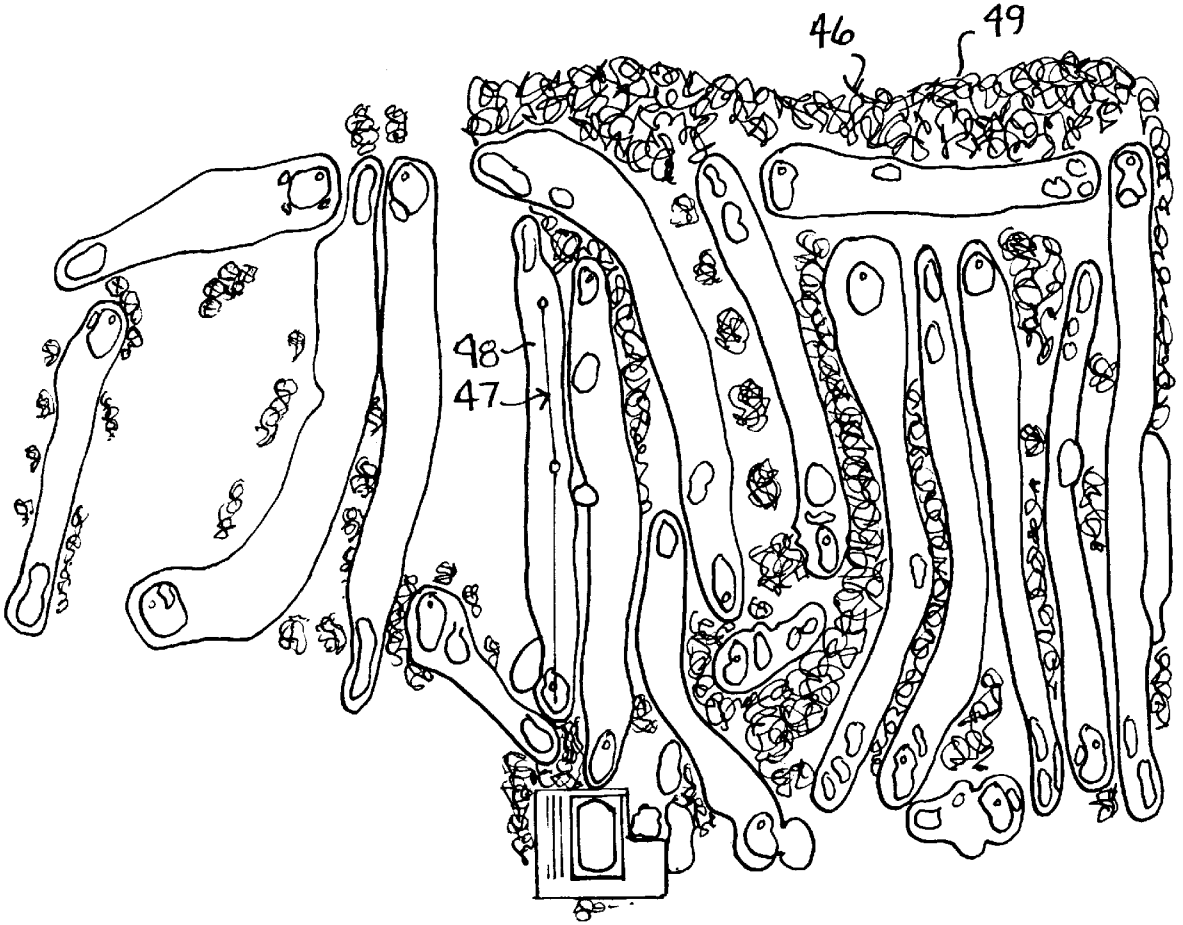
FIG. 3 illustrates a report of golf game data generated by the system of FIG. 1.

Turning to the drawings, in which like reference characters indicate corresponding elements throughout the several views, FIG. 1 illustrates a schematic representation of a system 10 for collecting and managing golf game data and for generating a report of golf game data. System 10 comprises an individual subscriber unit 11, global positioning system (GPS) 12 and a service 13. Unit 11 is preferably discrete and run by a self-contained power source such as one or more batteries. Unit 11 has a receiver 14, storage 15 and a computer or processor 16 that is run and managed by software. Storage 15 can be resident, remote, or a combination of resident and remote storage, and comprises one or more databases that hold information. Storage 15 can serve a variety of purposes such as holding software for running processor 16 and perhaps generating a report of the invention to be discussed later in this specification. GPS 12 is comprised of a network of earth-orbiting satellites. Unit 11 subscribes to and communicates with GPS 12. The satellites of GPS 12 transmit signals, usually on a time schedule precisely controlled by atomic clocks. By entering commands or inputs into unit 11, receiver 14 selects the satellites of GPS 12 most favorably located and relays their signals into a GPS computer, which calculates the position of the receiver by solving three or four simultaneous algebraic equations. Included in the calculations may be what is referred to as IDGPS software, which increases the accuracy of the position calculations. This technology will not be described in greater detail, as it is well known in the art. These commands may be entered through unit 11 input device 17 (FIG. 2), which may comprise a keypad 15 as shown or a pointing device such as a mouse or trackball. The GPS computer may be remote, resident or contained by unit 11, or may otherwise comprise at a part of service 13. Processor 16 may be configured to operate as the GPS computer. Unit 11 includes a display 18 for showing maps to indicate global positioning, golf game data, the power available by the self-contained power source, and other potential forms of data relating to unit 11 operation or golf game data display. Display 18 may comprise a liquid crystal display or other suitable visual display.

Service 13 has storage 21 and a computer or processor 22. Service 13 can be remote (centrally located), resident (local, residential or personal computer), or contained in a kiosk 23. Storage 21 can be resident, remote, or a combination of resident and remote storage, and comprises one or more databases that hold information. Storage 21 can serve a variety of purposes such as holding software for running processor 22 and for generating a report of the invention. Client 20 is a gateway or interface for accessing storage 21, which may comprise a personal computer, or a work station, keypad, pointer or other form of input device. In a particular embodiment, service 13 may comprise or incorporate a server accessible by client 20 over the Internet 23 through a publicly accessible web site 24. Although only one client is shown, service 13 may have more. If desired, service may comprise an element of a resident or Internet-based network having a plurality of clients linked together and/or to storage 21 by way of a resident network or a local area network (LAN) such as an Ethernet LAN or a token ring.

Unit 11 is preferably small and easy to carry in a pocket or clipped to clothing. In terms of operation, a golfer may take unit 11 and proceed to the first tee of the first hole of a golf course having a plurality of holes. Most golf courses have nine, eighteen, twenty-seven or thirty-six holes. Unit 11 may incorporate an ON/OFF switch for allowing a golfer to turn unit 11 "ON" and "OFF." Storage 15 typically contains software that deals with the specific operation of unit 11 in terms of collecting golf game data, and may be pre-programmed with specific golf course(s) data. By entering inputs into unit 11, such as through input device 30 (FIG. 2) of unit 11, the golfer may scroll through menu(s), select menu(s) items and input and collect golf game data. In this embodiment, input device 30 comprises a multifunctional keypad or button. In another embodiment, input device may comprise a pointer such as a mouse or trackball. The menu(s) may include golf game data selections concerning the path of golf ball traverse through a golf hole(s) and/or course(s), golf club identification for each stroke of a golf ball, golf hole(s) or golf game(s) scoring, golf course(s) identification, golf ball flight characteristics such as whether a golf ball traveled straight, sliced or hooked, and golf club to ball impact characterization data such as whether the ball was hit, square, fat or thin.

Upon approaching the first tee, the golfer may advance to the tee box and place his ball into a resting position. The term resting position is a position of a golf ball on a golf course from which it is to be struck. This resting position may comprise a location on the tee box, on or near a fairway including the rough, and on and around a green. After the golf ball is in the resting position, the golfer may enter inputs into unit 11 with input device 30, which might include the hole and/or golf course being played and/or club selection. After entering any desired information into unit, the golfer may then enter a "SWING" command into unit 11 by, for example, selecting or depressing a SWING 31 element or button of input device 30. Upon entering the "SWING" command, processor 16 stores the golfer-input data into storage 15 and the GPS positioning of the golfer, which is taken by receiver 14. Unit 11 may be configured to emit an audible or visual stimulus upon activation of the "SWING" command. The golfer may then proceed to hit his golf ball and then advance to the next resting position of the golf ball. Prior to advancing to the next resting position, the golfer may input details regarding ball flight and/or club-to-ball impact characteristics. At the next resting position of the golf ball, and all subsequent resting positions, the golfer may repeat the foregoing operation, and add any additional information regarding golf ball flight characteristics of each ball hit, club selection for each ball hit, club-to-ball impact characterization for each ball hit, etc. After completing each hole, the golfer can select a "FINISH HOLE" item of the menu(s). Unit 11 may be configured to emit an audible or visual stimulus upon activation of the "FINISH HOLE" command. In response to the "FINISH HOLE" command, processor 16 accesses storage 15 and, consistent with suitable software programming in combination with the positioned data provided by GPS 12, calculates the distance between each resting position and the location of each resting position, and stores all golf game data regarding the hole into storage 15. If desired, unit 11 may be coupled to processor 22 of service 13 over a remote two-way data transfer link 33, and processor 22 may be configured to carry out the FINISH HOLE calculations after making the "FINISH HOLE" command.

After completing a game of golf, which could be one hole, a plurality of holes, nine holes, eighteen holes or more, the golfer can, in a particular embodiment, select a "FINISH GAME" item of the menu(s). Unit 11 may be configured to emit an audible or visual stimulus upon activation of the "FINISH GAME" command. In response to the "FINISH GAME" command, processor 16 accesses storage 15 and, consistent with suitable software programming, generates a report of the golf game data, which is stored into storage 15 and/or displayed on display 18. If desired, unit 11 may be coupled to processor 22 of service 13 over remote two-way data link, and processor 22 may be configured to carry out the report generation in response to the "FINISH GAME" command. Rather then employ a "FINISH GAME" command after completing a game of golf, a golfer may couple unit 11 in data transfer communication with service 13 at kiosk 23 or client 20. To facilitate data transfer between unit 11 and service 13, unit 11 and client 20 and/or kiosk 23 may be equipped with suitable electronic data transfer apparatus or read/write capabilities for effecting a downloading of the golf game data from unit 11 to service 13. This downloading step may be carried out in response to deliberate commands tendered by the golfer, or, in response to specific software programming, automatically upon achieving a data link between unit 11 and service 13. Processor 16 and/or processor 22 may be provided to facilitate this downloading in response to appropriate software programming. Upon completion of data transfer, which occurs between storage 15 and storage 16, processor 22 generates a report of the golf game data either automatically or in response to golfer commands. This report may be stored into storage 21 and/or storage 15, displayed at display 18, client 20 and/or kiosk 23, and/or printed of formed at unit 11, client 20 and/or kiosk. One or more of unit 11, client 20 and kiosk may be provided with printing apparatus and capability. Storage 21 may include a database housing reports of golf game data of many golfers, which golfers may access for effecting comparisons between them and other golfers.

The report comprises a visual representation of the golf game data. In a particular embodiment, a report 40 may comprise a chart 41 showing hole 42 identification, shot 43 identification, club 44 identification for each shot 43 and the distance 45 of each shot 43. Chart 41 shows an example of golf game data for one hole only for the purpose of illustration, and may be provided to display golf game data of a plurality of holes. Given the various kinds of golf game data a golfer may employ, record 40 may take on many different forms depending on specific needs and desires. It is preferred, however, that in addition to chart 41 record include a visual representation 46 of a golf course 49 that was played, with a visual representation 47 of the resting positions. It is preferred that the visual representation 47 overlay the visual representation 46 of each golf hole 48 of golf course 49. This provides an exemplary and easy to perceive display. It is also preferred that the resting positions of each hole be connected with lines to show shot trajectory and perhaps distance. Visual representation 46 of golf course 49 may be provided as a map, a photograph or the like.

The invention has been described above with reference to one or more preferred embodiments. However, those skilled in the art will recognize that changes and modifications may be made in the described embodiments without departing from the nature and scope of the invention. Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A system comprising:

apparatus for collecting golf game data including an identification of a selected golf hole, an initial resting position of a golf ball preceding play of the selected golf hole, and each individual resting position of the golf ball throughout play of the selected golf hole, the apparatus being coupled to a positioning system for determining the individual resting positions of the golf ball;

a data storage device for receiving the collected golf game data from the apparatus; and a computer coupled to the data storage device for generating a report of the collected golf game data, the report comprising a visual representation of the selected golf hole and a visual representation of each of the individual resting positions of the golf ball throughout the play of the selected golf hole indicating a path of the golf ball, from the initial resting position to a pin for the selected golf hole and including all of the individual resting positions, associated with the visual representation of the selected golf hole.

2. The system of claim 1, wherein the golf game data further comprises an identification of a club.

3. The system of claim 1, wherein the golf game data further comprises a score.

4. The system of claim 1, wherein the visual representation of the golf hole includes a map of the golf hole.

5. The system of claim 1, wherein the visual representation of the golf hole includes a photograph of the golf course.

6. The system of claim 1, wherein the visual representation of the golf hole and visual representation of the resting positions of the golf ball throughout the play of the hole are displayed on a monitor.

7. The system of claim 1 wherein the golf game data includes identification of a plurality of holes and a plurality of resting positions of the golf ball throughout the play of the plurality of holes.

8. The system of claim 1 wherein at least a portion of the data storage device and the apparatus form a subscriber unit.

9. The system of claim 8 wherein a portion of the data storage device is located remotely from the subscriber unit.

10. The system of claim 1, wherein the computer comprises a computer network.

11. The system of claim 10, wherein the data storage device is accessable over the computer network.

12. A data collection and management method comprising the steps of:

determining a resting position of a golf ball using an individual subscriber unit coupled to a positioning system;

storing the resting position with the electronic individual subscriber unit during a golf game;

downloading the stored resting position to a computer;

repeating the steps of determining, storing and downloading for a plurality of resting positions during a game of golf; and with the computer, generating a report of the resting positions including generating a visual representation of the golf course and a visual representation of the resting positions, the report comprising a visual representation of all golf holes in the golf course and a visual representation of all of the individual resting positions of the golf ball throughout the play of each of the golf holes, and the report indicating a path of the golf ball from an initial resting position to a pin for each of the golf holes including all of the individual resting positions for each of golf holes associated with the visual representation of each of the golf holes.

13. The method of claim 12, further including the step of collecting golf game data associated with the resting position.

14. The method of claim 13, wherein the step of collecting golf game data further includes the step of collecting the golf game data with the individual subscriber unit during a golf game.

15. The method of claim 13, wherein the step of collecting golf game data further includes the step of p recording an identification of one or more golf holes with the individual subscriber unit.

16. The method of claim 13, wherein the step of collecting golf game data further includes the step of recording a flight characteristic of each flight path of each struck golf ball with the individual subscriber unit.

17. The method of claim 13, wherein the step of collecting golf game data further includes the step of recording golf club to ball impact characterization data with the individual subscriber unit.

18. The method of claim 12, wherein the step of generating a report further includes the step of generating a visual representation of the golf course and overlying a visual representation of the resting positions thereon.

19. The method of claim 12, wherein the step of downloading further includes the step of downloading to a database of a computer.

20. The method of claim 18, further including the step of printing a copy of the report including the visual representation of the golf course and the visual representation of the resting positions on the golf course.

21. The method of claim 12, wherein the step of generating a report further includes the step of generating a visual representation of a golf ball flight path on the golf course between the visual representation of the resting positions.

* * * * *